US005704806A

United States Patent [19]

Post et al.

[11] Patent Number: 5,704,806

[45] Date of Patent: Jan. 6, 1998

[54] THROUGH-WALL ELECTRICAL CONNECTOR HOUSING

[75] Inventors: Lothar Andreas Post, Offenbach; Harald Schmitt, Alsbach-Hähnlein, both of Germany

[73] Assignee: The Whitaker Corporation, Wilmington, Del.

[21] Appl. No.: 612,602

[22] Filed: Mar. 1, 1996

[30] Foreign Application Priority Data

Mar. 16, 1995 [GB] United Kingdom ..... 9505351

[51] Int. Cl.[6] ..... H01R 13/74

[52] U.S. Cl. ..... 439/546; 439/544; 439/335

[58] Field of Search ..... 439/546–549, 439/332–336, 544

[56] References Cited

U.S. PATENT DOCUMENTS 5,087,213 2/1992 Drapcho et al. ..... 439/336

*Primary Examiner*—Gary F. Paumen

*Attorney, Agent, or Firm*—Driscoll Nina

[57] ABSTRACT

An electrical connector housing fixable within an opening of a wall comprising an inner housing and an outer housing, characterized in that in response to relative movement between the housings resilient members which have passed through the opening are expanded outward preventing the housing from backing out of the wall, where the outer and inner housings may also include portions that define the receiving region wherein the mating connector halve must be received to be locked thereto that are only properly orientated when the housing is retained to the panel, thereby providing a through-wall housing that is easily inserted and affixed to a wall from one side thereof and preventing mating with the complementary connector half until the first connector half is locked to the panel.

5 Claims, 1 Drawing Sheet

THROUGH-WALL ELECTRICAL CONNECTOR HOUSING

BACKGROUND OF THE INVENTION

1. Field of the Invention

This invention relates to electrical connectors and in particular those electrical connectors that are mounted in a wall in order to form an electrical interconnection therethrough.

2. Description of the Prior Art

In industry there is a need for forming electrical connections across partitions or walls. One example of this is door-to-body electrical connections that must occur in an automobile. Another example would be in the electronics area where it is necessary to form an interconnection across the panels of an outer housing surrounding electronic equipment. There have been numerous connectors designed for this application.

One reoccurring problem though is that it is often necessary for the mating connector halves to be interconnected while having access to only one side of the wall or panel. This requires a first connector half to be inserted into an opening in the wall or panel and then retained there, which must occur with access to only one side of the panel. While it is simple enough to prevent the connector half from being over-inserted in the panel by simply incorporating a shoulder upon the connector half being inserted into the panel, the difficulty is in assuring the that connector half does not push back out of the opening while the second connector half is being mated therewith. This is because whatever features of the first connector housing that are now on the opposite side of the panel where the second connector half is being attached must have passed through the opening, thereby making it difficult to establish an interference with the panel to prevent the undesired back-out of the first connector half during the mating. In addition, the retention must be sufficiently robust, that when the mating connector half is inserted from the other side of the wall, the connector half mounted in the wall may not be permitted to back-out as the mating forces are being exerted.

It would also be desirable to assure that the first connector half is properly affixed to the panel prior to mating the second connector half from the other side of the panel. This would assure that the connector can not be assembled prior to being locked upon the panel which could result in, if the connector halves are successfully joined, a loose connector floating within the panel or the attempted mating process dislodging the first connector half from the panel afterwhich it would be necessary to perform additional work now on the insertion side of the panel to reposition the connector half.

SUMMARY OF THE INVENTION

It is an object of this invention to provide an electrical connector housing half that is mountable in an opening of a panel or wall from one side thereof and is positively retained.

It is another object of this invention that the electrical connector should be economical, easy to manufacture, and easy to use.

It is yet another object to provide an electrical connector housing that may be adapted for a sealed interconnection.

It is still yet another object to prevent mating of the connector halves until the first connector half is fully locked to the panel in its proper position.

An object of this invention may be accomplished by providing an electrical connector half for mounting in an opening through a wall to mate with a second connector half, where the connector comprises an inner housing having at least one terminal receiving passageway therein and an outer housing mounted thereupon, the electrical connector housing including a back-up shoulder extending outward beyond the opening to interfere with the wall to prevent over insertion and a mating connector receiving zone wherein a complementary feature of the second connector half is received for mating the two halves, the connector being characterized in that the connector has a first position where the connector passes through the opening without interference with the wall and a second position achieved by relative movement between the inner and outer housings wherein the first connector half is retained in the panel, where the inner and outer housings cooperate to define the receiving zone and are only properly aligned to define the receiving zone in the second position.

DETAILED DESCRIPTION OF THE PREFERRED EMBODIMENT

Figure 1:
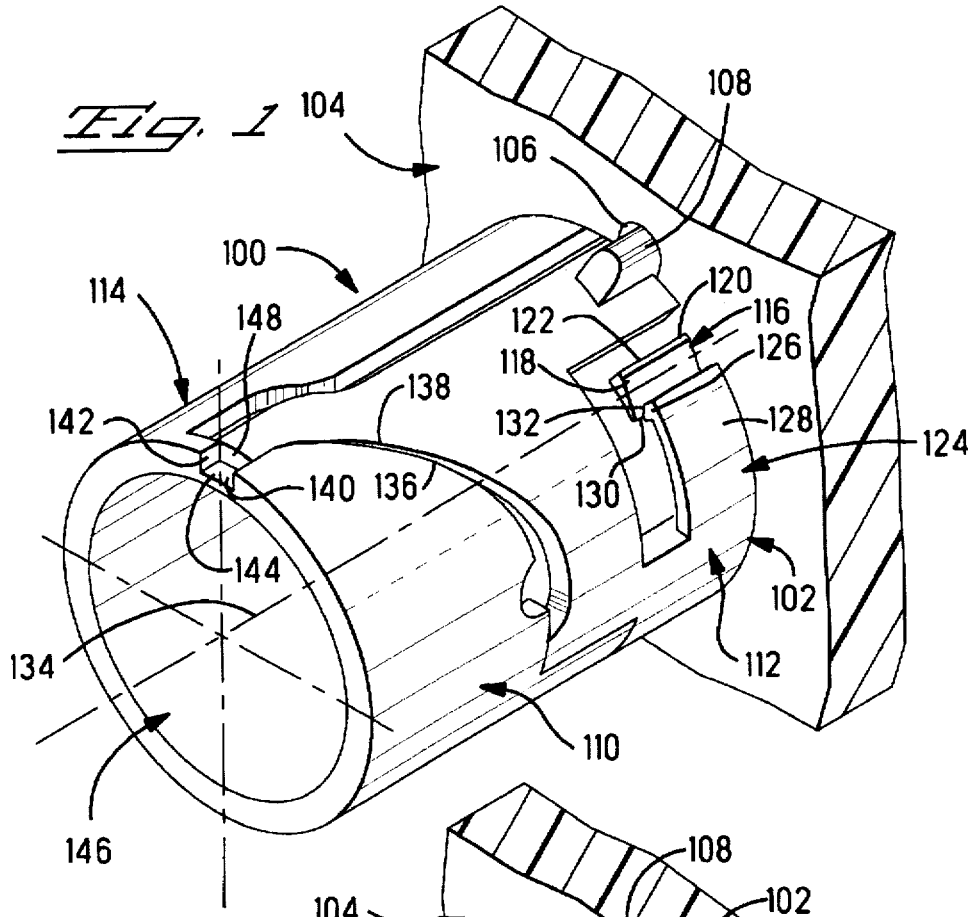
FIG. 1 is a perspective view of an electrical connector according to the present invention that additionally prevents mating with a complementary connector half unless fully locked to the panel, said connector shown in an unlocked position.

With reference now to FIG. 1, an embodiment of the present invention is shown generally at 100. The connector 100 is to be mounted in an opening 102 of a panel 104. The opening 102 includes a key cutout 106 that receives a complementary key 108 incorporated into the connector 100 to prevent rotation within the opening 102 thereof. The connector 100 includes first sleeve portion 110 and second sleeve portion 112 that are joined together to define the connector housing 114.

The first sleeve portion 110 includes a camming lug 116 having a camming surface 118, a biasing surface 120, and a locking surface 122. The second sleeve portion 112 includes a latch arm 124 having a latch head 126 disposed at the extreme end of a resilient and cantilevered latch arm 128. The latch head 126 includes a locking shoulder 130 and a camming face 132. The first sleeve portion 110 and the second sleeve portion 112 being rotatably displaceable relative to one another about a common central axis 134.

One common structure used to join mating connector halves is referred to as a bayonet connection. This structure incorporates a receiving track on one connector half and a following lug on the mating connector half. This structure is particularly advantageous where it is desirable to take up large linear displacement while only exerting minimal rotational displacement. While the invention is being described with respect to such a mating structure other structure, such as threads, tracks, pins and holes may also be used as will be apparent from the following description.

Each of the housing portions 110, 112 include oppositely facing profiles 136 and 138 respectively. In the first position, shown in FIG. 6, these profiles 136,138 are closely disposed. The first housing portion 110 further includes a mouth section 140 defined by a portion of the profile 136 thereupon, an oppositely facing wall 142 and a base surface 144. The mouth section 140 is open a mating end 146 of the connector half 100. The second housing portion 112 includes a stop wall 148 that blocks the mouth section 140 when the housing portions 110, 112 are in the first position.

Figure 2:
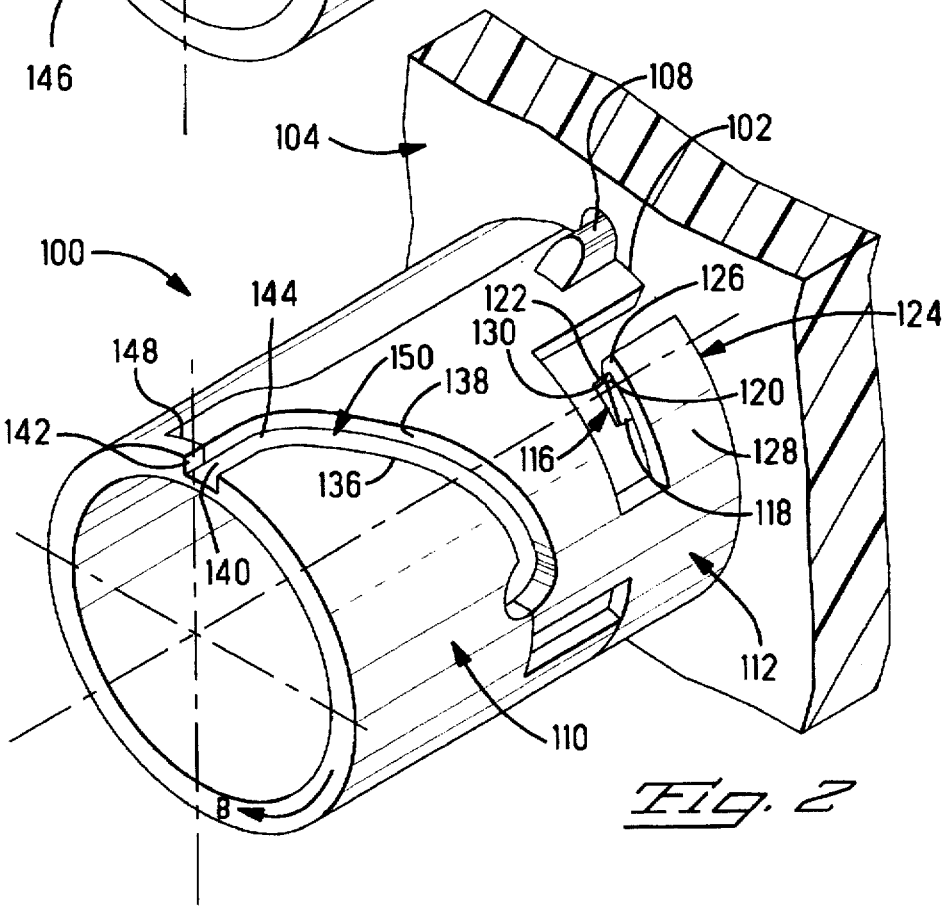
FIG. 2 is a perspective view of the electrical connector of FIG. 1 shown in a locked position.

With reference now to FIG. 2, by displacing the first housing portion 110 in the direction of Arrow B, the camming surface 118 of the latch 116 cooperates with the latch arm 124 to bias the arm 124 outward enabling the lug 116 to pass thereby, as previously described with respect to the above embodiment. Once the lug 116 has passed the head 126 of the latch arm 124, the arm 128 resiliently moves inward where it is supported by biasing surface 120 in a second position that captivates the panel 104 between the latch arm 124 and the shoulder (not shown) on the opposite side of the panel 104, thereby retaining the connector half 102 therewith. The housing portions 110,112 are prevented from being displaced back towards their first position positions by the lock and stop surfaces 122,130 of the lug and latch arm 116,124.

In this second position, the profiles 136,138 on the first and second housing portions 110,112 are further separated so that they are aligned to define a receiving region 150 to receive a mating feature of the complementary connector half (not shown). In this embodiment, the receiving region 150 is open as a bayonet slot. The receiving region is now continuous with the mouth 140 and the stop 148 has been displaced so that it is no longer blocking entry of the complementary lug of the mating connector half.

Advantageously, the present invention provides an electrical connector half that is fixable to a panel in such a manner that the complementary half may be mated therewith. It is also advantageous that the connector half may include a receiving region for a complementary feature of the mating connector half that is obstructed or discontiguous until the connector half is place into a locked position upon the panel. Furthermore, the structure is simple and economical to manufacture.

We claim:

1. An electrical connector half for mounting in an opening through a wall to mate with a second connector half, where the connector halt comprises an inner housing and an outer housing mounted thereupon, the electrical connector half including a mating connector receiving zone wherein a complementary feature of the second connector half is received for mating the two halves, the connector half being characterized in that the connector has a first position where the connector passes through the opening without interference with the wall and a second position achieved by relative movement between the inner housing and outer housing where the inner housing and outer housing cooperate to define the receiving zone only when the inner housing and outer housing are properly aligned to define the receiving zone in the second position.

2. The electrical connector half of claim 1 further characterized in that in the second position the connector half is affixed to the wall such that the connector is retained in the opening.

3. The electrical connector half of claim 2 further characterized in that one of the housings include a resilient arm biasable outward when the housings are moved to the second position to trap the wall behind the resilient arm.

4. The electrical connector half of claim 1 further characterized in that the receiving region is a bayonet track and each housing includes one of the defining walls thereof.

5. The electrical connector half of claim 3, further characterized in that one of the housings includes a mouth portion formed as an entrance to the receiving region where a portion of the other housing blocks the receiving region until the second position is established.

* * * * *